US010099490B2

(12) United States Patent
Sakano et al.

(10) Patent No.: US 10,099,490 B2
(45) Date of Patent: Oct. 16, 2018

(54) TAPE CARTRIDGE

(71) Applicant: Seiko Epson Corporation, Tokyo (JP)

(72) Inventors: Hideki Sakano, Suwa (JP); Shinsaku Kosuge, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/128,486

(22) PCT Filed: Mar. 19, 2015

(86) PCT No.: PCT/JP2015/058318

§ 371 (c)(1),
(2) Date: Sep. 23, 2016

(87) PCT Pub. No.: WO2015/146798

PCT Pub. Date: Oct. 1, 2015

(65) Prior Publication Data

US 2017/0113473 A1 Apr. 27, 2017

(30) Foreign Application Priority Data

Mar. 24, 2014 (JP) ..... 2014-060917

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 15/044; B41J 3/4075; B41J 32/00; B41J 2/315; B41J 2/32; B41J 2/325; B41J 2/17503; B41J 2/17506; B41J 2/17509; B41J 2/17513; B41J 2/1752; B41J 2/17523; B41J 2/17526; B41J 2/1753; B41J 2/17533; B41J 2/17536
See application file for complete search history.

(56) References Cited

U.S. PATENT DOCUMENTS 5,078,523 A * 1/1992 McGourty ..... B41J 17/32 400/207
6,113,292 A * 9/2000 Unno ..... B41J 2/32 400/578
2003/0089809 A1* 5/2003 Maekawa ..... G11B 15/07 242/332.4

FOREIGN PATENT DOCUMENTS

JP H05-155067 6/1993
JP H06-023760 3/1994
JP 2008-143121 6/2008

OTHER PUBLICATIONS

Search Report received in international Application No. PCT/2015/058318, dated Jun. 9, 2015.

* cited by examiner

*Primary Examiner* — Kristal Feggins
(74) *Attorney, Agent, or Firm* — ALG Intellectual Property, LLC

(57) ABSTRACT

A tape cartridge is to be mounted detachably in a tape printing apparatus provided with a cartridge mounting unit to be mounted with the tape cartridge and an apparatus-side lock portion which is provided in the cartridge mounting unit, function as a rigid body, and has an edge on which the tape cartridge mounted is to be locked in an unmounting direction. The tape cartridge includes a cartridge-side lock portion that is locked on the edge of the apparatus-side lock portion in such a manner as to be inclined without facing squarely any wall surface near the edge when the tape cartridge is mounted in the cartridge mounting unit, and a lock spring portion that supports the cartridge-side lock portion.

15 Claims, 11 Drawing Sheets

TAPE CARTRIDGE

CROSS-REFERENCE TO RELATED APPLICATIONS

This application is the U.S. National Phase under 35 U.S.C. § 371 of International Application No. PCT/JP2015/058318 filed on Mar. 19, 2015, which in turn claims the benefit of Japanese Application No. 2014-060917 filed on Mar. 24, 2014, the disclosures of which are expressly incorporated by reference herein.

TECHNICAL FIELD

The present invention relates to a tape cartridge to be mounted detachably in a cartridge mounting unit of a tape printing apparatus and subjected to printing by the tape printing apparatus.

BACKGROUND ART

A double-structure tape cartridge is known conventionally which is mounted in a recess of a tape copying apparatus and has a hole for a ribbon cartridge (refer to JP-5-155067).

The tape copying apparatus is composed of a reading unit for reading an image such as a lyric sheet and a printing unit for printing the read-out image. A recess in which the tape cartridge is to be mounted is formed in the printing unit. A thermal head for printing, a platen roller, a top feed roller, etc. are disposed in the recess. A pair of leaf springs for holding the tape cartridge mounted are erected in the recess.

On the other hand, the tape cartridge is rectangular and is formed with, as a portion of it, a hole in which houses a ribbon cartridge. The tape cartridge houses a tape to be subjected to printing and a bottom feed roller which is in rolling contact with the top roller. Furthermore, the tape cartridge is formed with two engagement portions with which the pair of leaf springs each having a nail are to engage. Each engagement hole is a hole that is formed in a top portion of a side wall of the tape cartridge. The nails of the leaf springs engage with the respective openings, whereby the tape cartridge is positioned and held in the recess.

SUMMARY

The above structure in which the tape cartridge is positioned and held by means of the pair of leaf springs erected in the recess has a problem that as the tape cartridge is mounted and unmounted repeatedly, the leaf springs are deformed plastically and, as a result, spring forces produced by them become weaker and their functions are impaired over time. That is, in the structure in which spring members (leaf springs) are provided on the apparatus side and non-spring members (engagement members) are provided on the tape cartridge side, the springiness may lower over time unless, for example, the spring members are sufficiently long. Or mounting and unmounting may be reduced in smoothness.

An object of the present invention is to provide a tape cartridge in which neither the springiness for mounting nor the smoothness of mounting and unmounting is lowered.

Means for Solving the Problems

The tape cartridge according to the invention is a tape cartridge to be mounted detachably in a tape printing apparatus provided with a cartridge mounting unit to be mounted with the tape cartridge and an apparatus-side lock portion which is provided in the cartridge mounting unit, functions as a rigid body, and has an edge on which the tape cartridge mounted is to be locked in an unmounting direction, characterized by comprising a cartridge-side lock portion which is locked on the edge of the apparatus-side lock portion in such a manner as to be inclined without facing squarely any wall surface near the edge when the tape cartridge is mounted in the cartridge mounting unit; and a lock spring portion which supports the cartridge-side lock portion.

According to this configuration, the tape cartridge can be smoothly attached to and detached from the apparatus-side lock portion having the edge and can be locked on it with an intended spring force. Furthermore, the tape cartridge is free of a problem that the springiness lowers over time such as the spring's being broken due to fatigue during a long-time use.

In the above configuration, it is preferable that when the tape cartridge is mounted in or unmounted from the cartridge mounting unit, the cartridge-side lock portion be given a displacement having a component in a direction that crosses a mounting/unmounting direction and a warp of the lock spring portion corresponding to the displacement become maximum halfway during a mounting or unmounting operation.

According to this configuration, the tape cartridge can be mounted and unmounted smoothly and can be locked without weakening of the spring force due to creep deformation.

It is preferable that the cartridge-side lock portion have a guide surface that forms an acute angle with the mounting/unmounting direction.

In this configuration, it is preferable that the guide surface have a first guide surface which forms an acute angle with a mounting direction of the mounting/unmounting direction and a second guide surface whose individual portions form an acute angle with the unmounting direction.

In this configuration, it is preferable that the guide surface further has a connection surface which is formed between the first guide surface and the second guide surface continuously with them so as to provide a click feeling at the time of a mounting or unmounting operation.

According to these configurations, the tape cartridge can be mounted and unmounted smoothly and can be locked securely. Furthermore, a proper click feeling can be obtained at the time of mounting or unmounting.

It is preferable that the cartridge-side lock portion have a press target slant surface which receives a reaction force from the apparatus-side lock portion and is given a component force in a mounting direction of a mounting/unmounting direction in a state that the cartridge-side lock portion is locked on the apparatus-side lock portion.

According to this configuration, a proper click feeling can be obtained by the press target slant surface at the time of mounting and the tape cartridge can be kept pressed relatively.

Furthermore, it is preferable that the lock spring portion extend in a direction that crosses a mounting/unmounting direction.

According to this configuration, since the lock spring portion extends in the direction that crosses the mounting direction, a sufficiently long lock spring portion can be formed irrespective of the thickness of the tape cartridge.

In the above configuration, it is preferable that the lock spring portion and the cartridge-side lock portion be integrated with each other.

According to this configuration, the lock spring portion and the cartridge-side lock portion can be simplified in structure.

In the above configuration, it is preferable that the lock spring portion and the cartridge-side lock portion be provided so as to form a double-supported beam.

This configuration makes it possible to stabilize the spring force that is produced at the time of mounting and unmounting.

It is preferable that the tape cartridge further comprise a cartridge case; and that the lock spring portion and the cartridge-side lock portion be band-shaped portions defined by removing two parallel linear portions from the cartridge case.

According to this configuration, the lock spring portion and a lock opening can be formed easily in a case wall of the cartridge case.

In the above configuration, it is preferable that the cartridge case have a shell structure which includes a ceiling wall located on the source side in a mounting direction of the mounting/unmounting direction, a bottom wall located on the destination side in the mounting direction, and a circumferential wall.

In this configuration, it is preferable that the lock spring portion and the cartridge-side lock portion be provided in one of the bottom wall and the circumferential wall.

Likewise, it is preferable that the lock spring portion and the cartridge-side lock portion be provided in an edge portion where the bottom wall and the circumferential wall are connected to each other.

According to these configurations, the lock spring portion and the cartridge-side lock portion can be formed easily without changing the outward shape or the internal structures.

On the other hand, it is preferable that two sets of the lock spring portion and the cartridge-side lock portion be provided so as to be spaced from each other.

According to this configuration, the cartridge case can be positioned in the cartridge mounting unit accurately and can be held securely.

In the above configuration, it is preferable that the circumferential wall of the cartridge case be provided with grip portions for mounting and unmounting operations at two confronting positions; and that the two sets of the lock spring portion and the cartridge-side lock portion be provided near the two respective grip portions.

According to this configuration, force that is produced at the time of mounting or unmounting can act directly on the lock spring portions and the cartridge-side lock portions. As a result, the cartridge case does not incline at the time of mounting or unmounting and hence can be mounted and unmounted smoothly.

It is preferable that the cartridge case include two divisional cases arranged in the mounting/unmounting direction; and that the lock spring portion and the cartridge-side lock portion be provided in one of the cases that is located on the destination side in the mounting direction of the mounting direction of the mounting/unmounting direction.

According to this configuration, the other case can be made a common part irrespective of presence/absence of the lock spring portion and the cartridge-side lock portion. Therefore, cost increase due to the formation of the lock spring portion and the cartridge-side lock portion can be suppressed.

DESCRIPTION OF EXEMPLARY EMBODIMENTS

A tape cartridge according to an embodiment of the present invention will be hereinafter described with reference to the accompanying drawings, together with a tape printing apparatus to be mounted with it. The tape printing apparatus serves to produce a label (tape piece) by performing printing while causing parts of a print tape and an ink ribbon to be paid out from the tape cartridge mounted therein and then cutting away a printed portion of the print tape.

[Outline of Tape Printing Apparatus]

Figure 1:
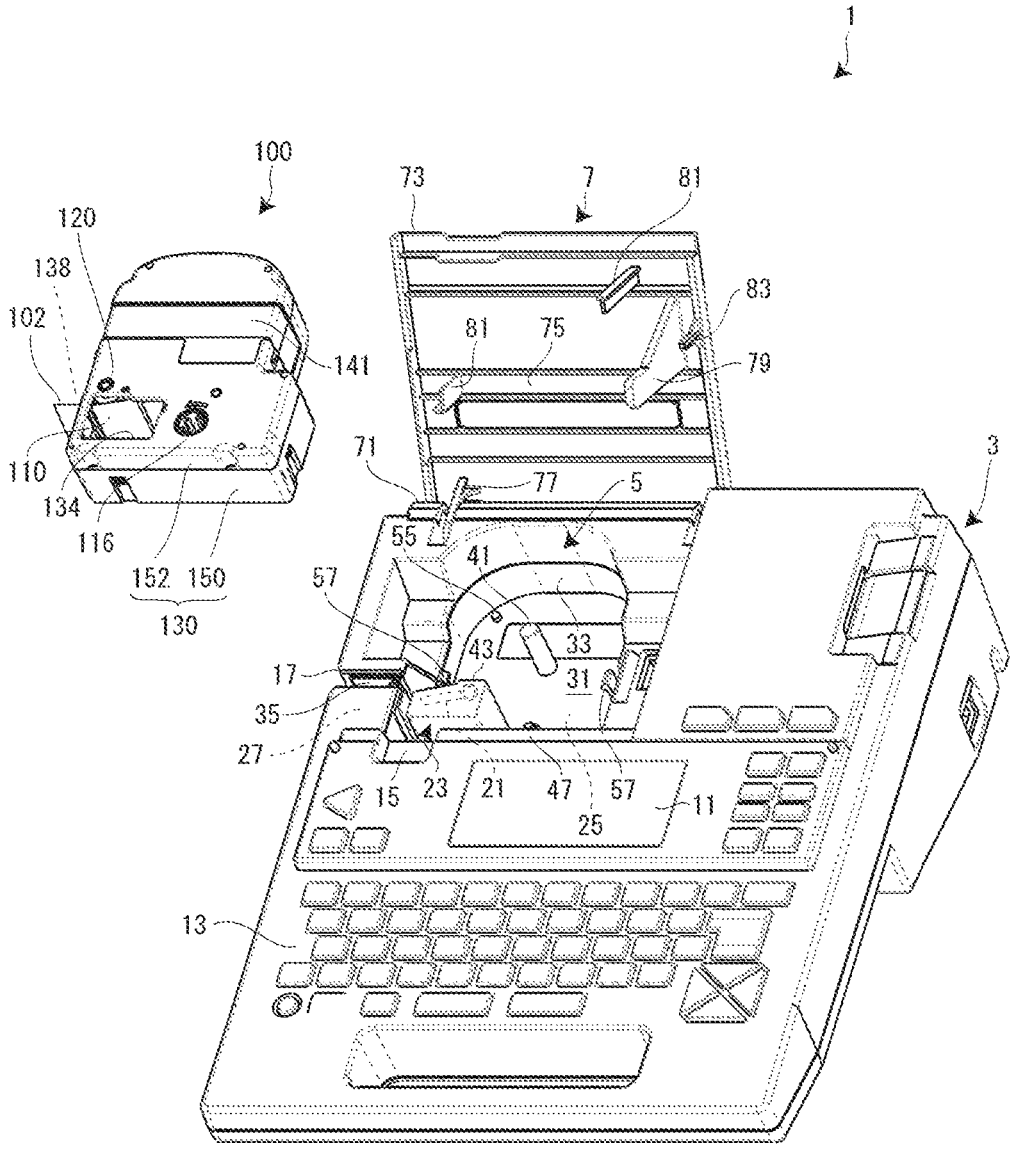
FIG. 1 is a perspective view showing an appearance of a tape printing apparatus according to an embodiment being in a lid-open state.

FIG. 1 is a perspective view showing an appearance of the tape printing apparatus and the tape cartridge to be mounted therein. As shown in this figure, the tape printing apparatus 1 is equipped with an apparatus case 3 as an outer case, a cartridge mounting unit 5 to be mounted with the tape cartridge 100 detachably, and an opening/closing lid 7 for opening and closing the cartridge mounting unit 5. The top surface of the apparatus case 3 is provided with the cartridge mounting unit 5 on the deep side, a display 11 at the center, and a keyboard 13 on the user side. A finger-hooking recess 15 is formed near the opening/closing lid 7. The opening/closing lid 7 is opened by lifting it up by hooking a finger on the recess 15. A side surface (left side surface) of the apparatus case 3 is formed with a vertically long tape outlet 17 through which part of a print tape 102 is to exit.

The tape printing apparatus 1 is also equipped with a print mechanism 23 having a print head 21 which is erected in the cartridge mounting unit 5, a tape feed mechanism 25 which is incorporated in a space formed on the back side of the cartridge mounting unit 5, and a tape cutting mechanism 27 which is incorporated near the tape outlet 17. A user inputs print information through the keyboard 13, checks the print information on the display 11, and starts printing by a key manipulation. Upon reception of a print instruction, the tape feed mechanism 25 is driven, whereby parts of the print tape 102 and an ink ribbon 110 run parallel with each other.

Furthermore, ink is transferred from the ink ribbon 110 to the print tape 102 by means of heat that is applied to the ink ribbon 110 from the print mechanism 23. Part of the print tape 102 advances to exit through the tape outlet 17 as this printing feed proceeds. Upon completion of the printing, the tape cutting mechanism 27 is driven, whereby a printed portion of the print tape 102 is cut away.

[Outline of Tape Cartridge]

Figure 2A:
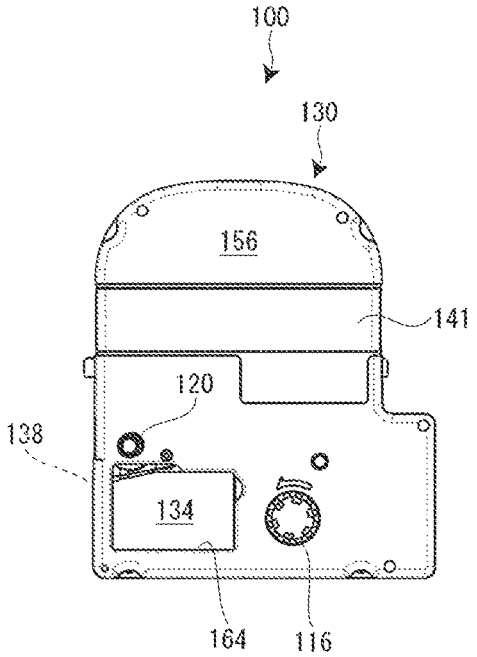
FIGS. 2A and 2B are a plan view and a side view, respectively, of a tape cartridge according to the embodiment.
Figure 2B:
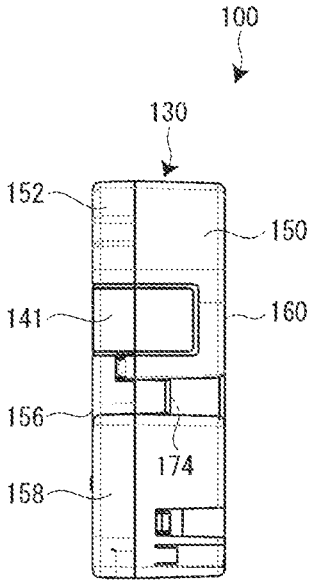
Figure 5A:
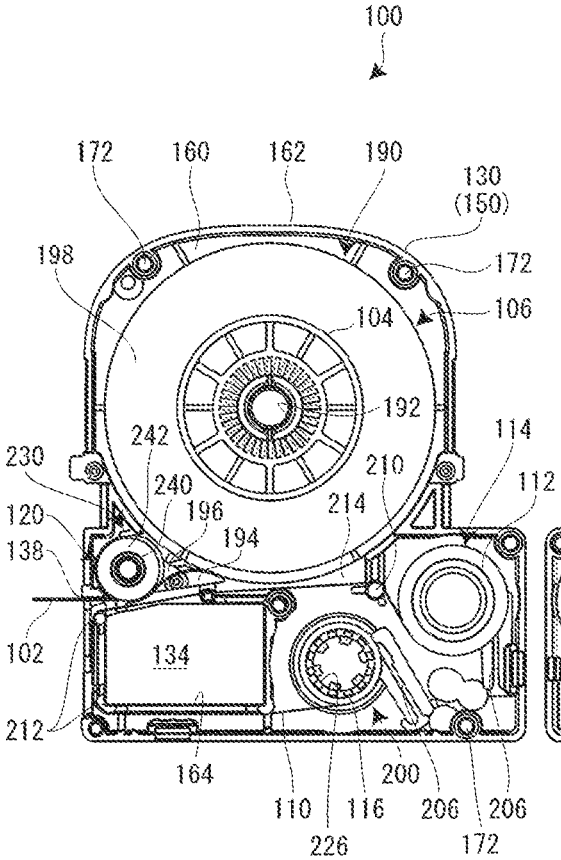
FIGS. 5A and 5B are a plan view of the tape cartridge from which a top case and a bottom case are removed and a bottom view of the top case, respectively.

As shown in FIGS. 2 and 5, the tape cartridge 100 is equipped with a tape roll 106 in which the print tape 102 is wound around a tape core 104 and a ribbon roll 114 in which the ink ribbon 110 is wound around a pay-out core 112. The tape cartridge 100 is also equipped with a take-up core 116 for taking up a used portion of the ink ribbon 110 and a platen roller (platen) 120 to which the print head 21 is to be brought into contact and which serves to feed the print tape 102 and the ink ribbon 110. The tape cartridge 100 is further equipped with a cartridge case 130 which houses the tape roll 106, the ribbon roll 114, the take-up core 116, and the platen roller 120. In this manner, the tape cartridge 100 according to the embodiment has what is called a shell structure in which the cartridge case 130 serves as an outer case.

The cartridge case 130 of the tape cartridge 100 is formed with an insertion opening 134 into which the print head 21 is to be inserted when the tape cartridge 100 is mounted in the tape printing apparatus 1. The cartridge case 130 of the tape cartridge 100 is also formed with a tape sending outlet 138 through which part of the print tape 102 is sent out. As described later in detail, the tape roll 106 is supported rotatably by a cylindrical core shaft 192 which projects in the inside space of the cartridge case 130.

When the platen roller 120 and the take-up core 116 are driven by the above-mentioned tape feed mechanism 25, part of the print tape 102 is paid out from the tape core 104 and part of the ink ribbon 110 is paid out from the pay-out core 112. The paid-out portions of the print tape 102 and the ink ribbon 110 run parallel with each other and are subjected to printing by the print head 21 when they run parallel with each other alongside the platen roller 120. The printed paid-out end portion (printed portion) of the print tape 102 is sent out from the tape sending outlet 138 to the tape outlet 17. On the other hand, the ink ribbon 110 goes around the circumferential wall of the insertion opening 134 and is taken up by the take-up core 116. Incidentally, plural kinds of tape cartridges 100 having different thicknesses are prepared to match respective tape widths of print tapes 102.

[Details of Tape Printing Apparatus]

Figure 3:
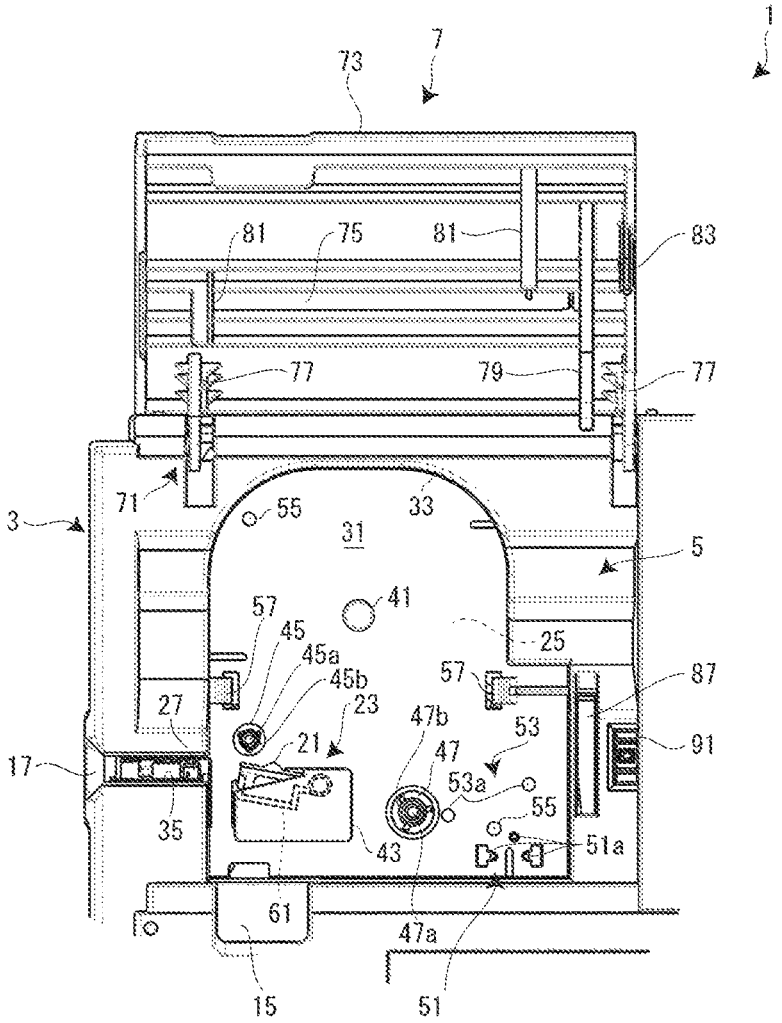
FIG. 3 is a plan view of a cartridge mounting unit.

As shown in FIGS. 1-3, the cartridge mounting unit 5 is shaped so as to be complementary in plan shape to the tape cartridge 100 and is recessed and has such a depth as to house the thickest one of the plural kinds of mountable tape cartridges 100. A mounting base 31 as a bottom plate portion and a side wall 33 of the cartridge mounting unit 5 are formed (molded) integrally with each other with resin or the like. A slit-like tape exit passage 35 is formed between the cartridge mounting unit 5 and the above-mentioned tape outlet 17, and the above-mentioned tape cutting mechanism 27 is incorporated adjacent to this portion.

A positioning projection 41 to be fitted with the above-mentioned core shaft 192 to position it, the print head 21 which is covered with a head cover 43, a platen drive shaft 45 for rotationally driving the platen roller 120, and a take-up drive shaft 47 for rotationally driving the take-up core 116 are erected from the mounting base 31 of the cartridge mounting unit 5. The mounting base 31 is provided with, near the take-up drive shaft 47, a tape detection unit 51 for detecting the type (attribute information) of the print tape 102 and a core release unit 53 for canceling the rotation stop of the pay-out core 112 and the take-up core 116.

The mounting base 31 is also provided with a pair of small projections 55 at diagonal positions and a pair of apparatus-side lock portions 57 for locking the tape cartridge 100 mounted. The pair of apparatus-side lock portions 57 are disposed so as to be left-right symmetrical with respect to the positioning projection 41, and back-surface portions of the tape cartridge 100 are to be locked on them (described later in detail). The apparatus-side lock portions 57 are formed (molded) integrally with the mounting base 31 and projects a short distance from the mounting base 31.

On the other hand, the above-mentioned tape feed mechanism 25 consisting of a motor, a gear train (neither of which are shown), etc. for rotating the platen drive shaft 45 and the take-up drive shaft 47 is incorporated in the space formed on the back side of the mounting base 31. The tape feed mechanism 25 rotates the platen drive shaft 45 and the take-up drive shaft 47 in a synchronized manner by dividing motive power by the gear train.

The print mechanism 23 has the print head 21 which is a thermal head and a head support frame 61 for supporting and swinging the print head 21. The print mechanism 23 also has a head release mechanism (not shown) for swinging the print head 21 between a printing position and an escape position via the head support frame 61 and the head cover 43 which covers the print head 21 (and the head support frame 61).

The head release mechanism, which operates in link with opening or closing of the above-mentioned opening/closing lid 7, moves (swings) the print head 21 to the printing position in link with a closing operation of the opening/closing lid 7. And the head release mechanism moves (swings) the print head 21 to the escape position in link with an opening operation of the opening/closing lid 7. At the printing position, the print head 21 comes into contact with the platen roller 120 via the ink ribbon 110 and the print tape 102. At the escape position, the print head 21 is separated from the platen roller 120. This prevents the print tape 102 or the ink ribbon 110 from interfering with the print head 21 when the tape cartridge 100 is mounted or unmounted.

The print head 21 is provided with plural heating elements, which are arranged in a row in the axial direction of the platen roller 120. Printing is performed as the print tape 102 and the ink ribbon 110 are fed and the plural heating elements are driven selectively. The head cover 43 is formed (molded) integrally with the above-mentioned mounting base 31 (cartridge mounting unit 5) so as to be approximately rectangular in a plan view. The head cover 43 projects a long distance from the mounting base 31 perpendicularly to it and allows the print head 21 to swing inside, and its outside circumference functions as a mounting guide for the tape cartridge 100.

The tape detection unit 51 consists of plural microswitches **51*a* which selectively engage with a detection target unit 180 (described later) of the tape cartridge 100 and thereby detects the type (tape width, tape color, material, etc.) of its print tape 102. The driving of the print head 21 and the tape feed mechanism 25** is controlled on the basis of a detection result.

The core release unit 53 consists of two release pins **53*a* for the pay-out core 112 and the take-up core 116. As described later in detail, the cartridge case 130 is formed with rotation stop hooks 206 to be hooked on the pay-out core 112 and the take-up core 116, respectively (see FIG. 6). When the tape cartridge 100 is mounted, the release pins 53*a*** engage with the respective rotation stop hooks 206, whereby the rotation stop of the pay-out core 112 and the take-up core 116 is canceled.

The platen drive shaft 45 has a fixed shaft 45*a* which extends long so as to be inserted into the platen roller 120 and a spline-shaped movable shaft 45*b* which is supported pivotally (rotatably) by a base portion of the fixed shaft 45*a*. Rotational power of the tape feed mechanism 25 is transmitted to the movable shaft 45*b* and then transmitted from the movable shaft 45*b* to the platen roller 120. Likewise, the take-up drive shaft 47 has a fixed shaft 47*a* and a spline-shaped movable shaft 47*b* which is supported pivotally (rotatably) by the fixed shaft 47*a*. Also in this case, rotational power of the tape feed mechanism 25 is transmitted to the movable shaft 47*b* and then transmitted from the movable shaft 47*b* to the take-up core 116.

When the tape cartridge 100 is mounted in the cartridge mounting unit 5, the core shaft 192 (tape core 104) engages with the positioning projection 41, the platen roller 120 engages with the platen drive shaft 45, and the take-up core 116 engages with the take-up drive shaft 47. When the opening/closing lid 7 is thereafter closed, the print head 21 is swung and comes into contact with the platen roller 120 with the print tape 102 and the ink ribbon 110 sandwiched between them, whereby the tape printing apparatus 1 is rendered in a print standby state.

Figure 4:
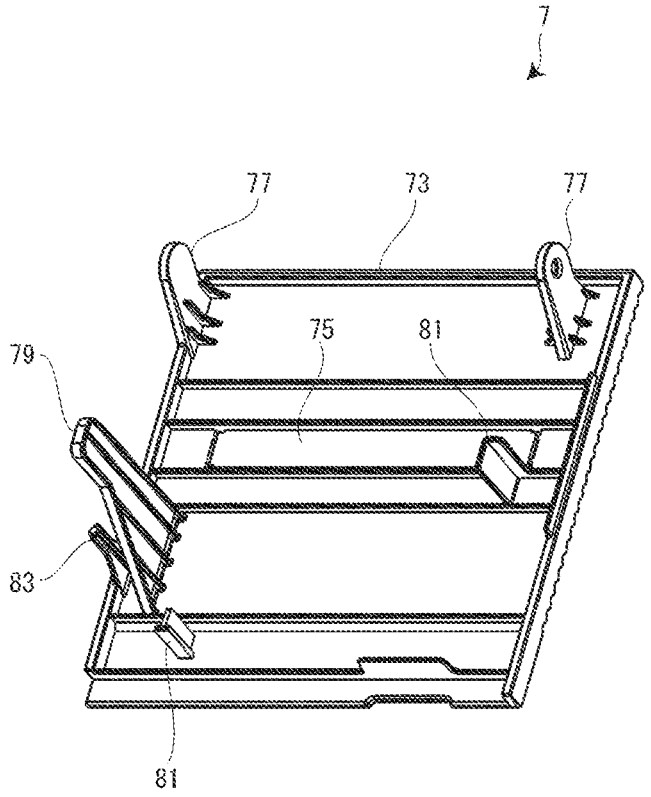
FIG. 4 is a perspective view, as viewed from the back surface side, of an opening/closing lid.

As shown in FIGS. 1 and 4, the opening/closing lid 7 is attached to the apparatus case 3 swingably (i.e., openably and closably) via hinges 71 which are disposed on the deep side. The opening/closing lid 7 has an opening/closing lid body 73 and an observation window 75 formed at the center. The opening/closing lid 7 also has a pair of pivoted pieces 77 which project from the back surface of the opening/closing lid body 73 and are pivotally (swingably) supported by the respective hinge 71 and an operation lever 79 which projects from the back surface of the opening/closing lid body 73 and serves to swing the print head 21. The opening/closing lid 7 further has two pushing projections 81 which project from the back surface of the opening/closing lid body 73 and serve to push the tape cartridge 100 and a push-down projection 83 which projects from the back surface of the opening/closing lid body 73 and serves to operate (i.e., turn on) a built-in lid closure detection switch (not shown).

The observation window 75 is long in the horizontal direction and is formed separately from the opening/closing lid body 73 with a transparent resin (transparent to visible light). The tape cartridge 100 mounted in the cartridge mounting unit 5 can be seen (i.e., the type and a tape residual amount of the print tape 102 can be recognized) through the observation window 75. The pair of pivoted pieces 77, the operation lever 79, the pushing projections 81, the push-down projection 83, and the opening/closing lid body 73 are formed (molded) integrally with each other with resin.

The operation lever 79, which projects a long distance from the back surface of the opening/closing lid body 73, is inserted into a slit opening 87 which is formed beside the cartridge mounting unit 5 when the opening/closing lid 7 is closed. When inserted into the slit opening 87, the operation lever 79 operates the above-mentioned head release mechanism and thereby swings the print head 21. Likewise, when the opening/closing lid 7 is closed, the push-down projection 83 is inserted into a rectangular opening 91 formed adjacent to the slit opening 87 and thereby operates (i.e., turns on) the lid closure detection switch. One pushing projection 81 is formed at a position that corresponds to a position near the platen roller 120 of the tape cartridge 100, and pushes the tape cartridge 100 so that it is placed on the mounting base 31 of the cartridge mounting unit 5 when the opening/closing lid 7 is closed.

[Details of Tape Cartridge]

Next, the tape cartridge 100 will be described in detail with reference to FIGS. 2, 5, and 6. In describing the tape cartridge 100, referring to FIG. 2, the surface of the tape cartridge 100 located on the source side in the mounting direction, that is, its front surface, will be referred to as a "front surface," the opposite surface located on the destination side in the mounting direction will be referred to as a "back surface," the left side surface and the right side surface will be referred to as they read, the top, arc-shaped side surface will be referred to as a "tip surface," and the bottom side surface will be referred to as a "base surface."

As described above, the tape cartridge 100 is equipped with the cartridge case 130, the tape roll 106, the ribbon roll 114, the take-up core 116, and the platen roller 120 which are housed in it. The tape cartridge 100 also has the insertion opening 134 formed in the cartridge case 130, the tape sending outlet 138 which is formed in the left side surface near the platen roller 120, and an identification seal 141 (see FIG. 1) which is stuck to portions, adjacent to the tape roll 106, of the front surface, the left side surface, and the right side surface. A tape width, a tape color, a material, etc. of the print tape 102 that is housed in the cartridge case 130 are shown by characters on two surfaces, that is, the front surface and the left side surface, of the identification seal 141.

The cartridge case 130 is an outer case of the tape cartridge 100 (shell structure), and has an L-shaped plan-view appearance in which a base portion of the right side surface projects a little. The cartridge case 130 is composed of a bottom case 150 and a top case 152 which are located on the destination side and the source side, respectively, in the front-to-back direction. In the cartridge case 130 employed in the embodiment, the top case 152 is a transparent resin mold and the bottom case 150 is an opaque resin mold.

A ceiling wall 156 having the front surface of the cartridge case 130 and a top circumferential wall 158 which goes down from the circumferential edge of the ceiling wall 156 are formed (molded) integrally with each other to form the top case 152. A bottom wall 160 having the back surface of the cartridge case 130, a bottom circumferential wall 162 which is erected from the circumferential edge of the bottom wall 160, and an opening circumferential wall 164 which is erected from the bottom wall 160 so as to define the above-mentioned insertion opening 134 are formed (molded) integrally with each other to form the bottom case 150.

Whereas the bottom end surface of the top circumferential wall 158 of the top case 152 is formed with plural joining pins 170 at proper intervals, and the bottom circumferential wall 162 of the bottom case 150 is formed with plural joining holes 172 at positions corresponding to the positions of the plural joining pins 170, respectively (see FIG. 5). The tape cartridge 100 is assembled by setting the components such as the tape roll 106 and the ribbon roll 114 in the bottom case 150 and then joining the top case 152 to the bottom case 150 so that the plural joining pins 170 are press-fit into the plural respective joining holes 172. To make the molding easier, the joining holes 172 are formed as through-holes.

Figure 6:
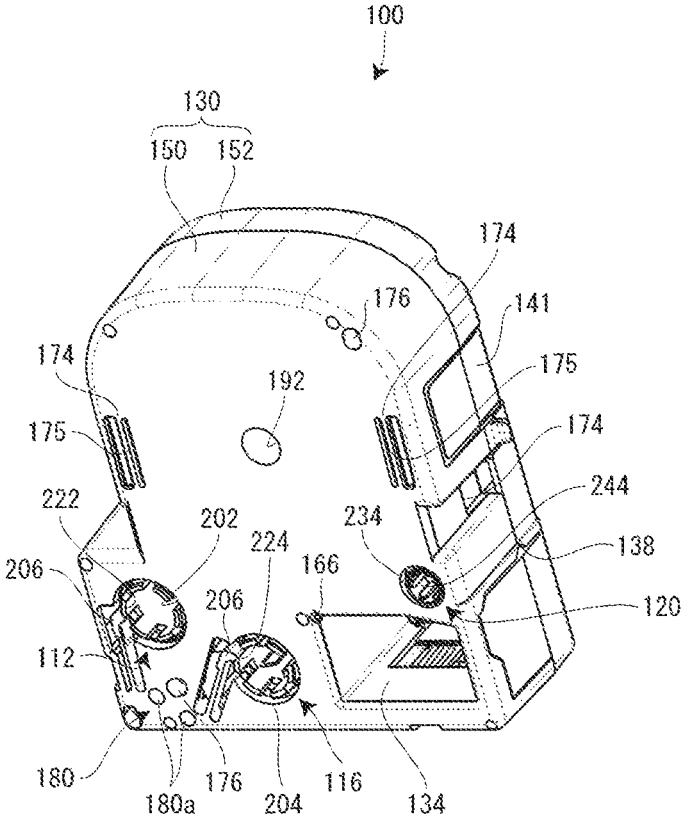
FIG. 6 is a perspective view, as viewed from the back surface side, of the tape cartridge.

On the other hand, the bottom wall 160 of the bottom case 150 is provided with lock structures 174 having a pair of cartridge-side lock portions 175 to engage with the above-mentioned pair of apparatus-side lock portions 57, respectively (see FIG. 6). By locking the pair of cartridge-side lock portions 174 of the tape cartridge 100 mounted on the apparatus-side lock portions 57 of the cartridge mounting unit 5, the tape cartridge 100 is held (positioned) in the cartridge mounting unit 5 (on the mounting base 31) (described later in detail).

The back surface of the bottom case 150 is formed with fitting small holes 176 to be fitted with the above-mentioned pair of small projections 55, respectively, with small margins (see FIG. 6). The pair of small projections 55 of the cartridge mounting unit 5 are fitted into the pair of fitting small holes 176 of the tape cartridge 100 mounted, whereby the tape cartridge 100 is positioned simply on the mounting base 31.

Furthermore, a base-surface-side left corner portion (a right corner portion when viewed from the front surface side) of the back surface of the bottom case 150 is formed with a detection target unit 180 which corresponds to the above-mentioned tape detection unit 51 (see FIG. 6). The detection target unit 180 is formed in portions corresponding to the plural microswitches 51*a* of the tape detection unit 51, and plural bit patterns are obtained depending on presence/absence of receiving holes 180*a* there. That is, the bit pattern corresponds to the type of the above-mentioned print tape 102.

As shown in FIG. 5, a wide tape housing area 190 for housing the tape roll 106 is formed in an upper space (located on the tip surface side) of the cartridge case 130. The core shaft 192 which is formed (molded) integrally with the bottom case 150 is erected at the center of the tape housing area 190. The core shaft 192 is cylindrical, and the tape roll 106 (tape core 104) is supported pivotally (rotatably) by the outer circumferential surface of the core shaft 192. A tape guide 194 for guiding a paid-out portion of the print tape 102 to the platen roller 120 is erected from the bottom case 150 integrally with it near the platen roller 120 in the tape housing area 190.

That is, a tape feed passage 196 which extends from the tape roll 106 past the tape guide 194 and the platen roller 120 to the tape sending outlet 138 is formed inside the cartridge case 130. A portion, paid out from the tape roll 106, of the print tape 102 is guided to the platen roller 120 via the tape guide 194, subjected to printing there, and then guided from the platen roller 120 to the tape sending outlet 138.

The tape roll 106 has not only the print tape 102 and the tape core 104 but also two films 198 which are stuck to the two respective end surfaces of the roll-like print tape 102. The two films 198 prevent disintegration of the print tape 102 which is wound on the tape core 104. Although not shown in any drawings, the tape core 104 incorporates a reverse rotation preventive mechanism. When the tape cartridge 100 is carried, reverse rotation of the print tape 102 is prevented by the reverse rotation preventive mechanism. On the other hand, when the tape cartridge 100 is mounted in the cartridge mounting unit 5 of the tape printing apparatus 1, the reverse rotation prevention by the reverse rotation preventive mechanism is canceled by the above-mentioned positioning projection 41, whereby feeding of the print tape 102 is enabled.

A ribbon housing area 200 is formed adjacent to the insertion opening 134, that is, in a right-hand space of the base portion of the cartridge case 130. Pay-out-side bearings 202 for supporting the ribbon roll 114 (pay-out core 112) rotatably are formed at a right-hand position of the ribbon housing area 200 and take-up-side bearings 204 for supporting the take-up core 116 rotatably are formed at a left-hand position of the ribbon housing area 200, so as to be integral with the cartridge case 130. That is, each of the top case 152 and the bottom case 150 is formed with a pay-out-side bearing 202 and a take-up-side bearing 204.

Rotation stop hooks 206 are formed integrally in such a manner that tip portions of the rotation stop hooks 206 are located in cuts of the pay-out-side bearing 202 and the take-up-side bearing 204 of the bottom case 150, respectively. One rotation stop hook 206 is engaged with the pay-out core 112 so as to stop rotation of the pay-out core 112, and the other rotation stop hook 206 is engaged with the take-up core 116 so as to stop rotation of the take-up core 116.

A first ribbon guide 210 for guiding a paid-out portion of the ink ribbon 110 to the platen roller 120 is erected from the bottom case 150 integrally with it near the pay-out-side bearing 202 in the ribbon housing area 200. The outer circumferential surface of the above-mentioned opening circumferential wall 164 is formed with plural second ribbon guides 212 for guiding a portion, going around the opening circumferential wall 164, of the ink ribbon 110 in such a manner that the second ribbon guides 212 are integral with the opening circumferential wall 164.

That is, a ribbon feed passage 214 which extends from the ribbon roll 114 past the first ribbon guide 210, the platen roller 120, and the plural second ribbon guides 212 to the take-up core 116 is formed inside the cartridge case 130. A portion, paid out from the ribbon roll 114, of the ink ribbon 110 is guided to the platen roller 120 via the first ribbon guide 210, is subjected to printing there, then goes around the opening circumferential wall 164 (passes the plural second ribbon guides 212) starting from the platen roller 120, and is finally taken up by the take-up core 116.

Figure 5B:
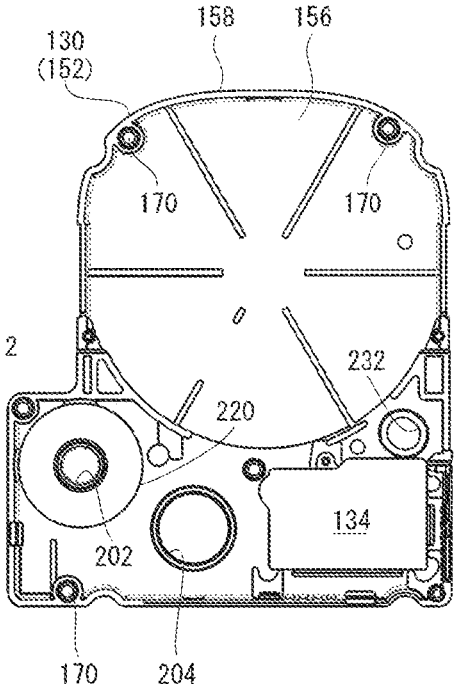

The ribbon roll 114 has not only the ink ribbon 110 and the pay-out core 112 but also a circular-ring-shaped leaf spring 220 for exerting a braking load on the pay-out core 112 (see FIG. 5B). The leaf spring 220 extends in a wavelike manner in the circumferential direction and is interposed between the ceiling wall 156 of the top case 152 and the pay-out core 112 in the axial direction. That is, a rotation braking load produced by the resilient force of the leaf spring 220 is exerted on the pay-out core 112. As a result, a portion, paid out by the take-up core 116, of the ink ribbon 110 is given back tension and thereby prevented from being loosened.

The pay-out core 112 is cylindrical and its end portion in the bottom case 150 is formed with plural cuts 222 in the circumferential direction (see FIG. 6). The above-mentioned rotation stop hook 206 engages with or disengages from the plural cuts 222. Whereas the bottom-case-150-side pay-out-side bearing 202 for supporting the pay-out core 112 has a circular opening, the top-case-152-side pay-out-side bearing 202 is a cylindrical projection. The above-mentioned leaf spring 220 is attached to this projection (see FIG. 5B).

Likewise, the take-up core 116 is cylindrical and its end portion in the bottom case 150 is formed with plural cuts 224 in the circumferential direction. The above-mentioned rotation stop hook 206 engages with or disengages from the plural cuts 224. The inner circumferential surface of the take-up core 116 is formed with spline grooves 226, and the take-up core 116 is spline-engaged with the above-mentioned take-up drive shaft 47. As a result, rotational power of the take-up drive shaft 47 is transmitted to the take-up core 116, whereby the ink ribbon 110 is taken up by the take-up core 116.

A platen housing area 230 is formed adjacent to the insertion opening 134, that is, in a left-hand space of the base portion of the cartridge case 130. A bottom bearing 234 having an elliptical opening (see FIG. 6) which is formed in the bottom case 150 and a top bearing 232 having an elliptical opening (see FIG. 5B) which is formed in the top case 152 are disposed at the center of the platen housing area 230. The platen roller 120 is supported by the top bearing 232 and the bottom bearing 234 so as to be rotatable and slightly movable in a horizontal direction. That is, the platen roller 120 which is supported by the top bearing 232 and the bottom bearing 234 which are elliptical is slightly movable in a horizontal direction between a home position where the platen roller 120 is to engage with the platen drive shaft 45 and a grip position where the platen roller 120 is in contact with the tape guide 194 to hold part of the print tape 102 between them.

Incidentally, the tape cartridge 100 is carried in a state that a very short paid-out end portion of the print tape 102 projects outward from the tape sending outlet 138 (see FIG. 1). If push-in force or pull-in force acts on the paid-out portion of the print tape 102 erroneously while the tape cartridge 100 is being carried, the platen roller 120 is moved to the above-mentioned grip position being dragged by the print tape 102. As a result, the paid-out end portion of the print tape 102 is prevented from being fully pulled into the cartridge case 130 through the tape sending outlet 138.

The platen roller 120 has a cylindrical roller base 240 and a rubber roller 242 which is attached to the outer circumferential surface of the roller base 240. The rubber roller 242 corresponds in axial length to the print head 21, and the print head 21 that has been moved to the printing position comes into contact with the rubber roller 242 with the print tape 102 and the ink ribbon 110 sandwiched between them. The inner circumferential surface of the roller base 240 is formed with spline grooves 244, and the roller base 240 is spline-engaged with the above-mentioned platen drive shaft 45. As a result, rotational power of the platen drive shaft 45 is transmitted to the platen roller 120, whereby the print tape 102 (and the ink ribbon 110) are fed for printing.

Structures of Cartridge-Side Lock Portions and Apparatus-Side Lock Portions (First Embodiment)

Next, referring to FIGS. 7-10, a detailed description will be made of the structure of the cartridge-side lock portions 175 of the tape cartridge 100 according to the first embodiment as well as the structure of the apparatus-side lock portions 57 of the cartridge mounting unit 5. As described above, the mounting base 31 of the cartridge mounting unit 5 is provided with the pair of apparatus-side lock portions 57 and the bottom case 150 of the tape cartridge 100 is provided with the pair of lock structures 174 including the pair of cartridge-side lock portions 175 in such a manner that they correspond to the pair of apparatus-side lock portions 57, respectively.

Figure 7:
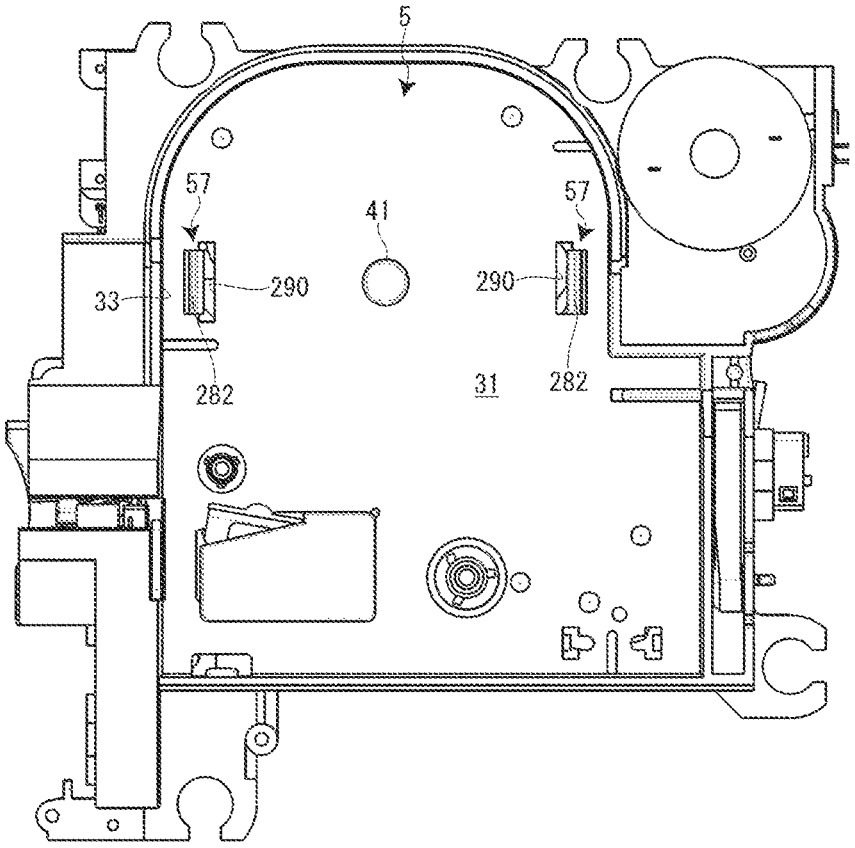
FIG. 7 is an enlarged plan view of the cartridge mounting unit.
Figure 9:
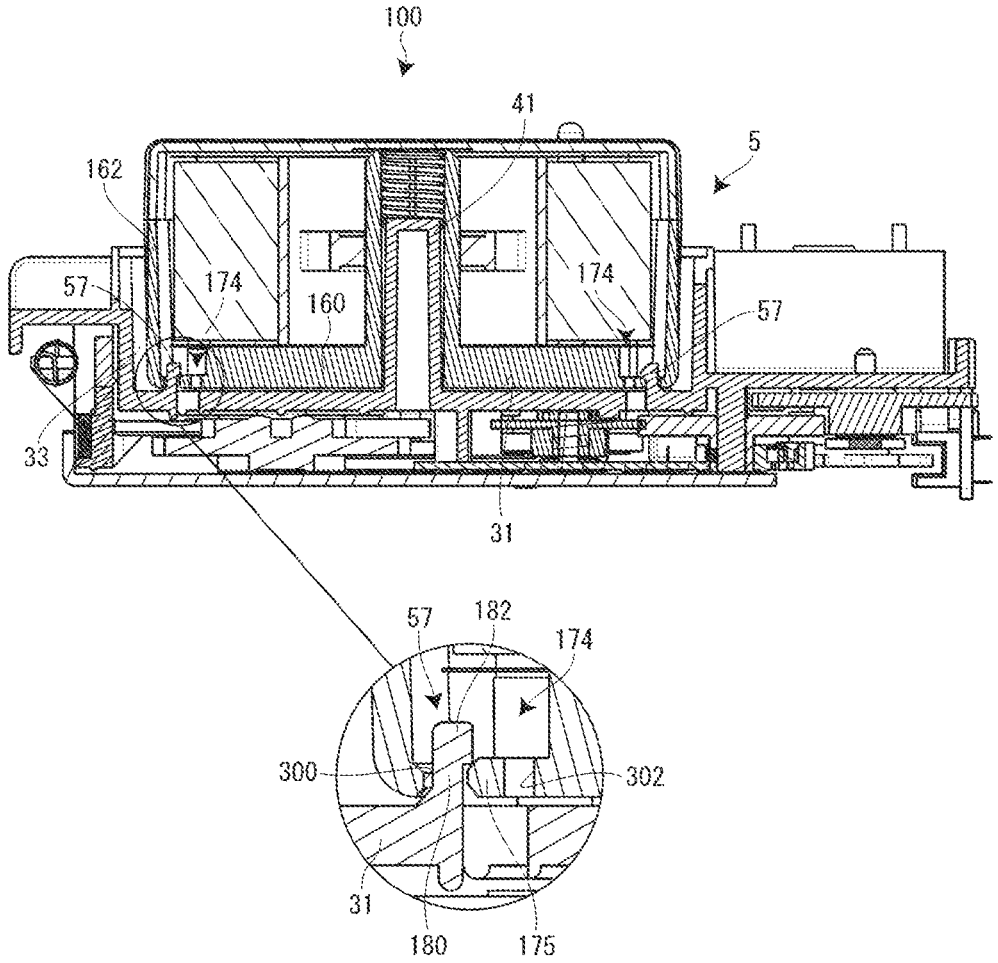
FIG. 9 is a sectional view of the tape cartridge according to the first embodiment in a state that it is mounted in the cartridge mounting unit.

As shown in FIGS. 7, 9, and 10, the pair of apparatus-side lock portions 57 are disposed on the mounting base 31 so as to be spaced from the positioning projection 41 to the left and right, respectively. Each apparatus-side lock portion 57 is shaped, as a whole, like a plate that is parallel with the side wall 33, and has a projecting main body 280 erected from the mounting base 31 and a locking hook portion 282 which extends form the tip of the projecting main body 280. The locking hook portion 282 is rectangular in cross section and projects toward the associated cartridge-side lock portion 175. A tip portion of the locking hook portion 282 has a top edge 284, a bottom edge (edge) 286, and a flat portion 288 which extends between the top edge 284 and the bottom edge 286.

The pair of apparatus-side lock portions 57 are disposed in such a manner that its locking hook portion 282 are opposed to each other. Each of these apparatus-side lock portions 57 functions as a non-spring member whereas each cartridge-side lock portion 175 functions as a spring member. Therefore, each apparatus-side lock portions 57 is substantially a rigid body and is formed so as to be strong and short. Incidentally, a mold drawing hole 290 for molding of each apparatus-side lock portion 57 is formed inside it.

Figure 8A:
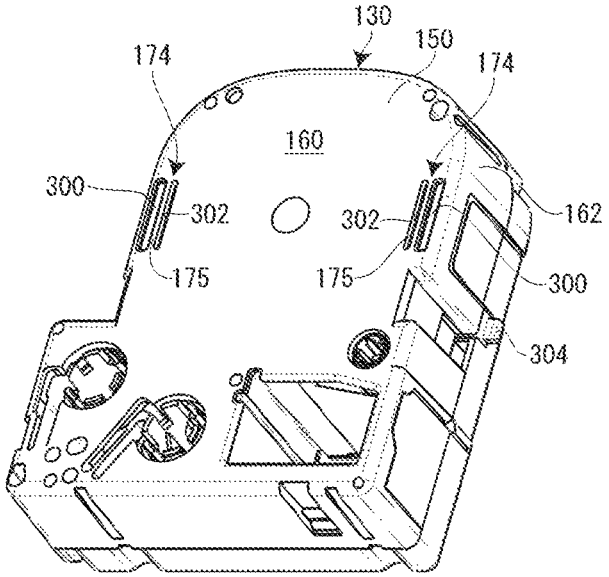
FIGS. 8A and 8B are a perspective view, as viewed from the back surface side, of the tape cartridge according to the first embodiment and a plan view of its bottom case, respectively.
Figure 8B:
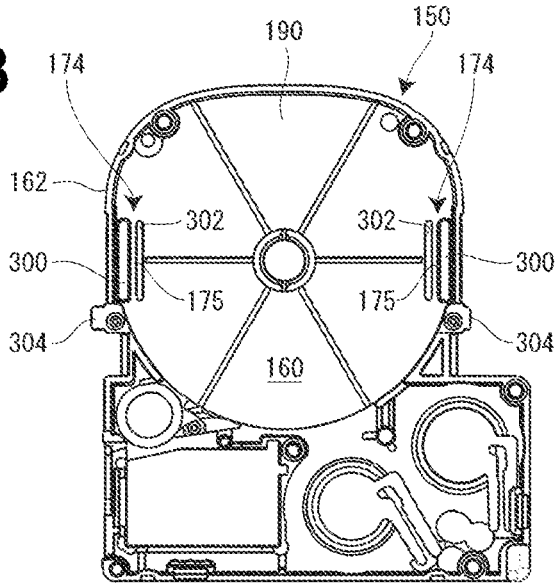

On the other hand, as shown in FIGS. 8 and 9, the bottom wall 160 of the bottom case 150 is formed with, at left and right end positions of the tape housing area 190, the pair of cartridge-side lock portions 175 to be locked on the pair of apparatus-side lock portions 57, respectively. The bottom wall 160 is also formed with a pair of lock openings 300 adjacent to the respective cartridge-side lock portions 175 and with a pair of linear openings (linear removed portions) 302 adjacent to the respective cartridge-side lock portions 175.

That is, each of the above-mentioned lock structures 174 is composed of the cartridge-side lock portion 175 having springness, the lock opening 300 into which the associated apparatus-side lock portion 57 is to be inserted, and the linear removed portion 302. The pair of lock structures 174 are disposed near respective edges where the bottom wall 160 and the bottom circumferential wall 162 are connected to each other. Furthermore, left and right top portions of the bottom circumferential wall 162 are formed with a pair of finger hook projections 304, respectively, where to grip the tape cartridge 100. In a plan view (i.e., when viewed from the mounting/unmounting direction of the tape cartridge 100), the pair of lock structures 174 are disposed near the pair of finger hook projections 304, respectively. Therefore, in engaging or disengaging the cartridge-side lock portions 175 with or from the respective apparatus-side lock portions 57 to mount or unmount the tape cartridge 100, one can apply forces to the lock structures 174 without causing any trouble relating to the mounting or unmounting.

Each lock opening 300 and each linear removed portion 302 that are associated with each other are slit-like openings that are located the two respective sides of the band-shaped cartridge-side lock portion 175 and formed by removing linear portions of the bottom wall 160. In other words, the cartridge-side lock portion 175 is a band-shaped portion, defined by the lock opening 300 and the linear removed portion 302 which are parallel-arranged slit-like openings, of the bottom wall 160.

The cartridge-side lock portion 175, the lock opening 300, and the linear removed portion 302 extend parallel with each other and parallel with the bottom wall 162. The cartridge-side lock portion 175, the lock opening 300, and the linear removed portion 302 have the same length and sufficiently longer than the apparatus-side lock portion 57.

In the above structure, the lock opening 300 has a slit width that corresponds to the width of the projecting main body 280 of the apparatus-side lock portion 57. And the linear removed portion 302 has such a slit width that allows the cartridge-side lock portion 175 to warp. In a relative locking operation in which apparatus-side lock portion 57 is locked on the cartridge-side lock portion 175, an operation that the projecting main body 280 of the apparatus-side lock portion 57 is inserted into the lock opening 300 and an operation (locking operation) that the locking hook portion 282 of the apparatus-side lock portion 57 warps the cartridge-side lock portion 175 toward the linear removed portion 302 and goes over it are performed simultaneously.

As shown in FIGS. 9 and 10, when the tape cartridge 100 is mounted or unmounted (the mounting and unmounting directions are indicated by a top/bottom double arrow in FIG. 10), the cartridge-side lock portion 175 exhibits springiness by being warped by the locking hook portion 282 of the apparatus-side lock portion 57. That is, the cartridge-side lock portion 175 has a structure that a portion on which the apparatus-side lock portion 57 (locking hook portion 282) is to be locked and a portion for supporting the lock target portion elastically are integrated with each other. The cartridge-side lock portion 175 is shaped like what is called a double-supported beam and has such a width as to be warped properly toward the linear removed portion 302 and thereby exhibit springiness.

When the tape cartridge 100 is mounted in the cartridge mounting unit 5, the locking hook portion 282 of each apparatus-side lock portion 57 comes into contact with the cartridge-side lock portion 175, which is thereby warped toward the linear removed portion 302. As a result of the bend of the cartridge-side lock portion 175, the apparatus-side lock portion 57 goes over the cartridge-side lock portion 175 and is locked on it while being inserted relatively in the lock opening 300. To unmount the tape cartridge 100, the cartridge-side lock portion 175 is disengaged from (pulled out of) the apparatus-side lock portion 57 according to an opposite procedure.

Incidentally, even where the apparatus-side lock portion 57 is made of a material, such as plastic, that is low in Young's modulus, can function substantially as a rigid body and can be regarded as a rigid body that is hard to be damaged if it is made thick and is shaped so as not to be deformed elastically.

When the tape cartridge 100 is mounted, the top edge 284, the flat portion 288, and the bottom edge 286 of the locking hook portion 282 come into contact with the cartridge-side lock portion 175 in this order (see FIG. 10). When the tape cartridge 100 is unmounted, the bottom edge 286, the flat portion 288, and the top edge 284 of the locking hook portion 282 come into contact with the cartridge-side lock portion 175 in this order (see FIG. 10). It is noted that the top edge 284 and the bottom edge 286 need not be like a sharp knife edge and may have a very narrow chamfered surface or an arc portion that is very small in curvature of radius in cross section. To warp the cartridge-side lock portion 175 smoothly when the locking hook portion 282 comes into contact with it at the time of mounting or unmounting of the tape cartridge 100, the cartridge-side lock portion 175 is formed with a guide surface 310 having a guide slant surface (first guide surface) 312, a press target slant surface (second guide surface) 314, and a connection surface 316 which connects the guide slant surface 312 and the press target slant surface 314.

The guide slant surface 312 serves to produce a component force for warping the cartridge-side lock portion 175 toward the linear removed portion 302 when it receives a force in the mounting direction at the time of mounting of the tape cartridge 100. To this end, the guide slant surface 312 is shaped so as to form an acute angle with the mounting direction. That is, the angle formed by the mounting direction and the guide slant surface 312 is smaller than 90°. As a result, the cartridge-side lock portion 175 is warped without causing any trouble and allows the locking hook portion 282 to go over itself smoothly.

Likewise, the press target slant surface 314 serves to produce a component force for warping the cartridge-side lock portion 175 toward the linear removed portion 302 when it receives a force in the mounting direction at the time of unmounting of the tape cartridge 100. To this end, the press target slant surface 314 is shaped so as to form an acute angle with the unmounting direction. That is, the angle formed by the unmounting direction and the press target slant surface 314 is smaller than 90°. As a result, the cartridge-side lock portion 175 is warped without causing any trouble and allows the locking hook portion 282 to go over itself smoothly.

The press target slant surface 314 is a portion with which with the bottom edge 286 comes into contact in a locked state. That is, in a state that the cartridge-side lock portion 175 is locked on the apparatus-side lock portion 57, the bottom edge 286 is in line contact with the press target slant surface 314 in the extension direction of the bottom edge 286 at a prescribed position on the press target slant surface 314 (i.e., in the cross section shown in FIG. 10, the position of point contact between the bottom edge 286 and the press target slant surface 314). That is, line contact that is a linear continuation of contact points each having a narrow contact area is established rather than surface contact having a wide contact area. In other words, the cartridge-side lock portion 175 is locked because the press target slant surface 314 and the bottom edge 286 are in contact with each other in such a manner that the cartridge-side lock portion 175 does not squarely face the flat surface 288 which is a wall surface close to the top edge 284 and the bottom edge 286. As a result, the spring force of cartridge-side lock portion 175 acts on the locking hook portion 282 and the tape cartridge 100 is pressed against the mounting base 31, receiving a resulting reaction force (component force).

Since the contact occurs in a narrow contact area at the prescribed position, variation of the spring force of the cartridge-side lock portion 175 and the corresponding reaction force (component force) acting there can be suppressed. This makes it possible to realize a correct spring force etc. that are equal to design values. It is noted that the bottom edge 286 need not always extend straightly in the direction perpendicular to the paper surface of FIG. 10 (i.e., the direction going from the viewer side of the paper surface to the deep side); the bottom edge 286 may be curved so as to deviate from the direction perpendicular to the paper surface of FIG. 10 and to come into point contact with the press target slant surface 314 even three-dimensionally.

Figure 10A:
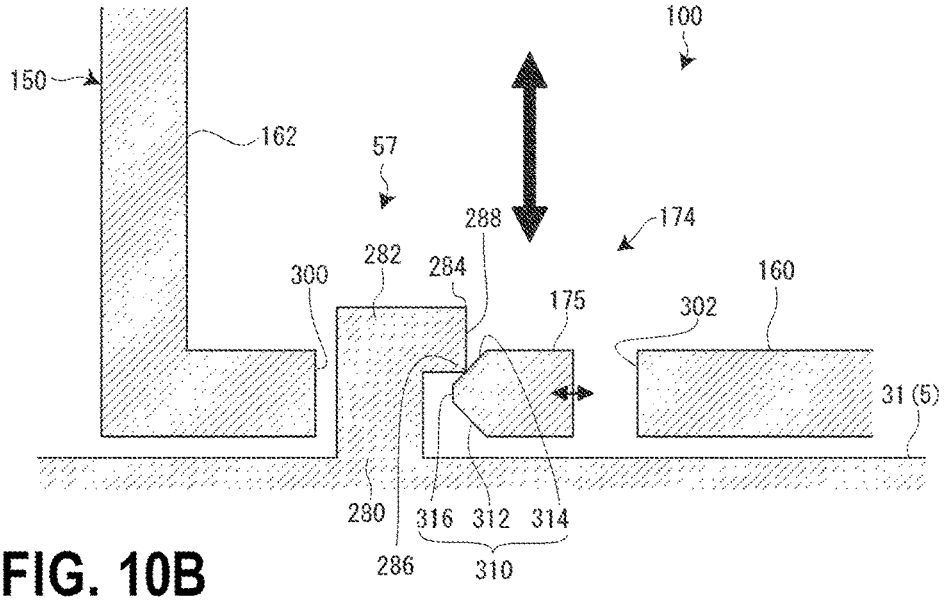
FIGS. 10A and 10B are explanatory diagrams schematically illustrating a relationship between a cartridge-side lock portion and an apparatus-side lock portion of the tape cartridge according to the first embodiment.

As shown in FIG. 10A, the press target slant surface 314 of the cartridge-side lock portion 175 is shaped so as to squarely face neither of the flat portion 288 and a hook bottom portion 289 of the locking hook portion 282 in a state that the tape cartridge 100 is mounted in the cartridge mounting unit 5. Thus, the bottom edge 286 can slide on the press target slant surface 314 when the tape cartridge 100 is unmounted from or mounted in the cartridge mounting unit 5. Therefore, trouble does not occur that the tape cartridge 100 is unmounted from the cartridge mounting unit 5 with the hook bottom portion 289 and the press target slant surface 314 kept engaged with each other. Furthermore, when the tape cartridge 100 is mounted in the cartridge mounting unit 5, the tape cartridge 100 can be positioned in the cartridge mounting unit 5 as a result of the bottom edge 286's pushing the press target slant surface 314.

Figure 10B:
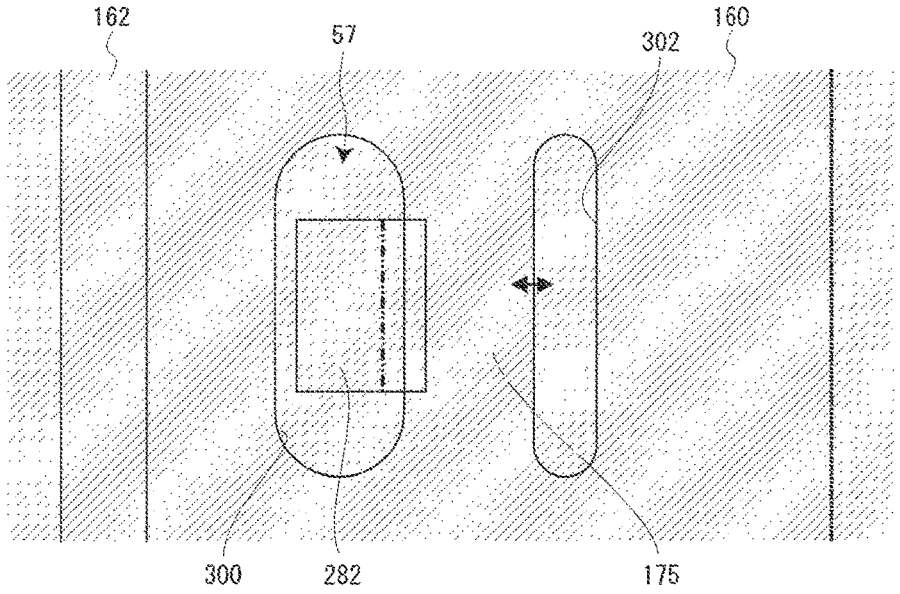

That is, since as shown in FIG. 10 the press target slant surface 314 and the bottom edge 286 are in line contact or point contact with each other (they are in contact with each other only in that contact line or at that contact point), the lock portion 175 is in contact with the bottom edge 286 in a state that the tape cartridge 100 is mounted in the cartridge mounting unit 5, to provide a clear load application point for the spring. As a result, the tape cartridge 100 is held stably by a spring force having a design value. By applying force of pulling out the tape cartridge 100 upward in the direction indicated by the arrow in FIG. 10, the tape cartridge 100 can be unmounted easily while the cartridge-side lock portion 175 is moved rightward in the horizontal direction indicated by the arrow in FIG. 10B and the bottom edge 286 slides on the press target slant surface 314.

The connection surface 316 is a surface that causes a peak of a warp of the cartridge-side lock portion 175 being in contact with it when the tape cartridge 100 is mounted or unmounted. Therefore, at the time of mounting, a click feeling is obtained as the portion being in contact with the locking hook portion 282 changes from the connection surface 316 to the press target slant surface 314. At the time of unmounting, a click feeling is obtained as the portion being in contact with the locking hook portion 282 changes from the connection surface 316 to the guide slant surface 312. As described above, the warp of the cartridge-side lock portion 175 peaks only instantaneously during an operation of mounting or unmounting the tape cartridge 100. Therefore, even if the tape cartridge 100 has been mounted in the cartridge mounting unit 5 for a long time, a phenomenon can be prevented that the spring force of the cartridge-side lock portion 175 is weakened due to its creep deformation or the like.

Incidentally, the guide slant surface 312, the press target slant surface 314, and the connection surface 316 need not always be flat surfaces. That is, the guide slant surface 312 may be a curved surface whose tangential line forms an acute angle with the mounting direction at each point. Likewise, the press target slant surface 314 may be a curved surface whose tangential line forms an acute angle with the unmounting direction at each point. The connection surface 316 may also be a curved surface.

Structures of Cartridge-Side Lock Portions and Apparatus-Side Lock Portions (Second Embodiment)

Figure 11A:
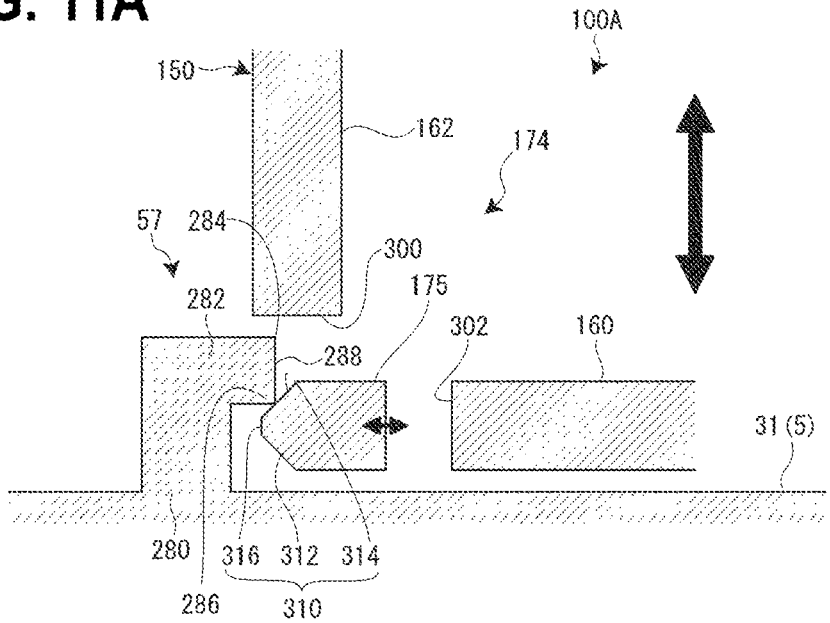
FIGS. 11A and 11B are explanatory diagrams schematically illustrating a relationship between a cartridge-side lock portion and an apparatus-side lock portion of a tape cartridge according to a second embodiment.
Figure 11B:
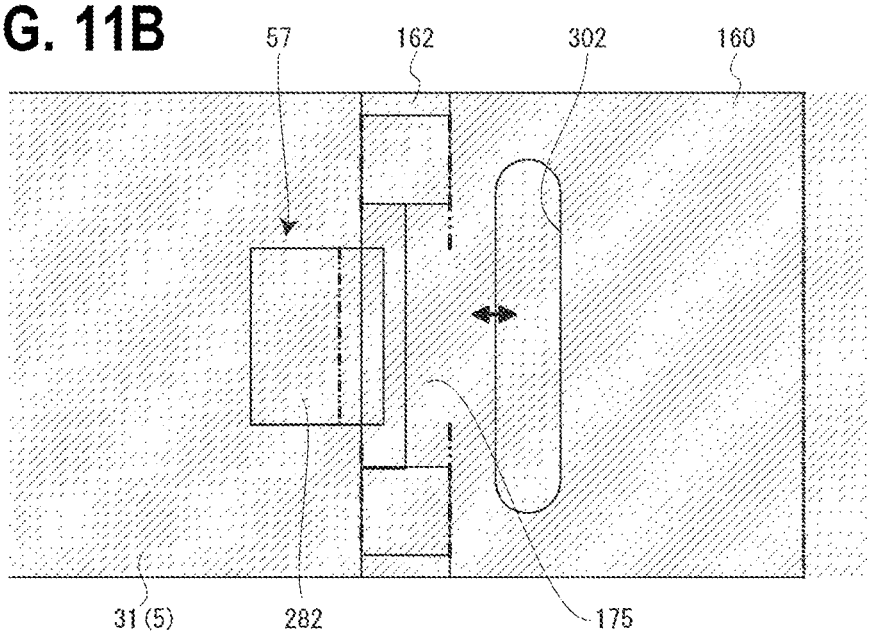

Next, referring to FIG. 11, a detailed description will be made of the structure of cartridge-side lock portions 175 of a tape cartridge 100A according to a second embodiment as well as the structure of apparatus-side lock portions 57 of the cartridge mounting unit 5. In the second embodiment, different portions than in the first embodiment will be described.

In this embodiment, the pair of lock structures 174 each consisting of a cartridge-side lock portion 175, a lock opening 300, and a linear opening 302 is different than in the first embodiment; each lock structure 174 is provided around an edge 320 formed by the bottom wall 160 and the bottom circumferential wall 162 of the bottom case 150. More specifically, the lock opening 300 is formed in the bottom circumferential wall 162 near the edge 320, the cartridge-side lock portion 175 is formed at the edge 320, and the linear opening 302 is formed bottom wall 160 near the edge 320. The mounting and unmounting directions of the tape cartridge 100A are indicated by a top/bottom double arrow in FIG. 11.

On the other hand, the apparatus-side lock portions 57 is similar in form as that employed in the first embodiment and are erected from the mounting base 31 at such positions as to correspond to the respective lock openings 300. Also in this case, the locking hook portion 282 of each apparatus-side lock portion 57 is rectangular in cross section. As in the first embodiment, each cartridge-side lock portion 175 is formed with a guide surface 310 having a guide slant surface 312, a press target slant surface 314, and a connection surface 316.

Also in this case, the angle formed by the mounting direction and the guide slant surface 312 and the angle formed by the unmounting direction and the press target slant surface 314 are smaller than 90°. As a result, the tape cartridge 100A can be mounted and unmounted smoothly and a proper click feeling can be obtained. And the tape cartridge 100A can be pressed against the mounting base 31. Furthermore, in the second embodiment, a longer distance (distance between fixed positions) can be secured between the cartridge-side lock portions 175 than in the first embodiment, whereby the tape cartridge 100A can be given a more stable mounting state.

As described above, according to the embodiments, since the tape cartridge 100 or 100A can be mounted and unmounted smoothly and a proper click feeling can be obtained because each cartridge-side lock portion 175 has, as the guide surface 310, the guide slant surface 312, the press target slant surface 314, and the connection surface 316 for the associated apparatus-side lock portion 57 having the locking hook portion 282 which is rectangular in cross section. Furthermore, each of the tape cartridge 100 and 100A can be locked properly on the cartridge mounting unit 5 while being pressed against it.

When the tape cartridge 100 or 100A is mounted in the cartridge mounting unit 5, the small-area portion, located at the particular position, of each cartridge-side lock portion 175 is locked on the small-area portion, located at the particular position, of the associated apparatus-side lock portion 57 (in a sectional view (e.g., in FIG. 11), the bottom edge 286 and the press target surface 314 are in point contact). Therefore, the tape cartridge 100 or 100A can be positioned correctly with respect to the cartridge mounting unit 5 by a force having a design value and can be held there. As a result, the tape cartridge 100 or 100A neither suffers positional deviation nor rises even if it receives force from the print head 21, for example.

Furthermore, since the cartridge-side lock portions 175 (lock structures 174) which function as springs are provided on the side of the tape cartridge 100 or 100A, it is not necessary to give springiness to the apparatus-side lock portion 57 and the projection dimension of the apparatus-side lock portions 57 can be shortened. In addition, since the lock structures 174 extend in the directions that cross the mounting direction, the cartridge-side lock portions 175 can be formed so as to have a sufficient length and can be designed easily so as to have a desired spring constant irrespective of the thickness of the cartridge case 130.

Although not shown in any drawings, a pair of lock structures 174 (cartridge-side lock portions 175) may be formed in the bottom circumferential wall 162 of the bottom case 150. Furthermore, a frame that links components may be provided in place of the cartridge case 130. In this case, the frame is formed with a pair of lock structures 174.

The invention claimed is:

1. A tape cartridge to be mounted detachably in a tape printing apparatus provided with a cartridge mounting unit to be mounted with the tape cartridge and an apparatus-side lock portion which is provided in the cartridge mounting unit, functions as a rigid body, and has an edge on which the tape cartridge, when mounted in the cartridge mounting unit, is to be locked in an unmounting direction, the tape cartridge comprising:

a cartridge-side lock portion that is locked on the edge of the apparatus-side lock portion in such a manner as to be inclined without facing squarely any wall surface near the edge when the tape cartridge is mounted in the cartridge mounting unit; and a lock spring portion that supports the cartridge-side lock portion, wherein, when the tape cartridge is mounted in or unmounted from the cartridge mounting unit, the cartridge-side lock portion is given a displacement having a component in a direction that crosses a mounting/unmounting direction and a warp of the lock spring portion corresponding to the displacement becomes maximum halfway during a mounting or unmounting operation.

2. The tape cartridge according to claim 1, wherein the cartridge-side lock portion has a guide surface that forms an acute angle with the mounting/unmounting direction.

3. The tape cartridge according to claim 2, wherein the guide surface has a first guide surface which forms an acute angle with a mounting direction of the mounting/unmounting direction and a second guide surface whose individual portions form an acute angle with an unmounting direction of the mounting/unmounting direction.

4. The tape cartridge according to claim 1, wherein the cartridge-side lock portion has a press target slant surface which receives a reaction force from the apparatus-side lock portion and is given a component force in a mounting direction of the mounting/unmounting direction in a state that the cartridge-side lock portion is locked on the apparatus-side lock portion.

5. The tape cartridge according to claim 1, wherein the lock spring portion extends in the direction that crosses the mounting/unmounting direction.

6. The tape cartridge according to claim 5, wherein the lock spring portion and the cartridge-side lock portion are integrated with each other.

7. The tape cartridge according to claim 6, wherein the lock spring portion and the cartridge-side lock portion are provided so as to form a double-supported beam.

8. The tape cartridge according to claim 5, wherein the tape cartridge further comprises a cartridge case, and the lock spring portion and the cartridge-side lock portion are band-shaped portions defined by removing two parallel linear portions from the cartridge case.

9. The tape cartridge according to claim 8, wherein the cartridge case has a shell structure which includes a ceiling wall located on a source side in a mounting direction of the mounting/unmounting direction, a bottom wall located on a destination side in the mounting direction, and a circumferential wall.

10. The tape cartridge according to claim 9, wherein the lock spring portion and the cartridge-side lock portion are provided in one of the bottom wall and the circumferential wall.

11. The tape cartridge according to claim 9, wherein the lock spring portion and the cartridge-side lock portion are provided in an edge portion where the bottom wall and the circumferential wall are connected to each other.

12. The tape cartridge according to claim 9, wherein two sets of the lock spring portion and the cartridge-side lock portion are provided so as to be spaced from each other.

13. The tape cartridge according to claim 12, wherein the circumferential wall of the cartridge case is provided with grip portions for mounting and unmounting operations at two confronting positions, and the two sets of the lock spring portion and the cartridge-side lock portion are provided near the two respective grip portions.

14. The tape cartridge according to claim 9, wherein the cartridge case includes two divisional cases arranged in the mounting/unmounting direction, and the lock spring portion and the cartridge-side lock portion are provided in one of the two divisional cases located on the destination side in the mounting direction of the mounting/unmounting direction.

15. A tape cartridge to be mounted detachably in a tape printing apparatus provided with a cartridge mounting unit to be mounted with the tape cartridge and an apparatus-side lock portion which is provided in the cartridge mounting unit, functions as a rigid body, and has an edge on which the tape cartridge, when mounted in the cartridge mounting unit, is to be locked in an unmounting direction, the tape cartridge comprising:

a cartridge-side lock portion that is locked on the edge of the apparatus-side lock portion in such a manner as to be inclined without facing squarely any wall surface near the edge when the tape cartridge is mounted in the cartridge mounting unit;

a lock spring portion that supports the cartridge-side lock portion and that extends in a direction that crosses a mounting/unmounting direction; and a cartridge case, wherein the lock spring portion and the cartridge-side lock portion are band-shaped portions defined by removing two parallel linear portions from the cartridge case.

* * * * *